313-414 SR
4/26/83 OR 4,381,473

United States Patent [19]
Endoh et al.
[11] 4,381,473
[45] Apr. 26, 1983

[54] IN-LINE TYPE ELECTRON GUN STRUCTURE

[75] Inventors: Satoru Endoh; Mamoru Ikeda; Minoru Yabe; Mitsuru Igarashi, all of Mobara; Masaaki Yamauchi, Togane, all of Japan

[73] Assignee: Hitachi, Ltd., Tokyo, Japan

[21] Appl. No.: 172,416

[22] Filed: Jul. 25, 1980

[30] Foreign Application Priority Data

Jul. 25, 1979 [JP] Japan ..... 54-93762

[51] Int. Cl.³ ..... H01J 29/50
[52] U.S. Cl. ..... 313/414
[58] Field of Search ..... 313/414

[56] References Cited

U.S. PATENT DOCUMENTS 4,028,581 6/1977 Stratton ..... 313/414

FOREIGN PATENT DOCUMENTS 50-105068 8/1975 Japan .
53-70664 6/1978 Japan .

*Primary Examiner*—Palmer C. Demeo
*Attorney, Agent, or Firm*—Charles E. Pfund

[57] ABSTRACT

In an in-line type electron gun structure including three in-line type electron guns and a plurality of grid electrodes respectively aligned with the electron guns, each sleeve electrode has a length equal to at least 50% of an inner diameter thereof and the inner diameter is gradually increased toward a free end of the sleeve-shaped electrode from a point at about one half of the length thereof. This construction eliminates an auxiliary electrode, thus reducing the cost of manufacturing.

3 Claims, 17 Drawing Figures

IN-LINE TYPE ELECTRON GUN STRUCTURE

BACKGROUND OF THE INVENTION

This invention relates to an in-line type electron gun structure, more particularly improvement of the electrode construction thereof.

Generally, in order that three electron guns usually used in a color picture tube have an excellent convergence characteristic, an electron gun structure has been used in which three electron guns are closely assembled in an integral form.

FIG. 1 of the accompanying drawing illustrates one example of a prior art in-line type electron gun structure in which a cathode holder 1 is provided to hold three parallelly disposed cathode electrodes 2 which are arranged in line. The cathode electrodes 2 contain heaters 3 to constitute electron beam emitting members. Above the cathode electrodes 2 are disposed in succession a first grid assembly 4 which controls the electron beams, a second grid assembly 5 for accelerating the electron beams and third and fourth grid assemblies 6 and 7 constituting an electron lens, various grid assemblies being supported by glass beads 8. By the action of these grid assemblies, the electron beams are caused to impinge upon selected phosphor picture elements of the color picture tube.

The third and fourth grid assemblies 6 and 7 are also called main lens electrodes and respectively comprise three sleeve electrodes 6*a*, 6*b* and 6*c* and 7*a*, 7*b* and 7*c* which are in register with the respective electron beam emitting members. A cylindrical auxiliary electrode 9 is coaxially provided for each sleeve electrode. The purpose of the auxiliary electrodes 9 is to prevent the side walls of the third and fourth grid assemblies from affecting the electric field created in the third and fourth grid assemblies 6 and 7. Accordingly, it is not necessary to provide the auxiliary electrodes 9 as long as the sleeve electrodes, 6*a*, 6*b*, 6*c*, 7*a*, 7*b*, and 7*c* have a length that can satisfy a predetermined condition and the accuracy of circular inner shape of these sleeve electrodes is sufficiently high.

FIG. 2 is a graph showing the relationship between the ratio of the sleeve length L to the sleeve diameter D and the focusing characteristic of an electron beam. The graph was obtained by using main lens electrodes which were produced by machining non-magnetic stainless plates which otherwise have been prepared by press work. In FIG. 2, the focusing characteristic is expressed by a ratio of the longitudinal dimension B of the beam spot to the lateral dimension A of the beam spot at the central portion of the fluorescent screen of the color picture tube. As can be noted from FIG. 2, it is ideal that the longitudinal to lateral ratio B/A of the beam spot is 1.0, that is, the cross-section is a circle. However, it has been found that error of ±5%, that is, the ratio of from 0.95 to 1.05 does not affect the focusing characteristic of the color picture tube. FIG. 2 also shows that in order to obtain a satisfactory focusing characteristic for a color picture tube and to eliminate auxiliary electrodes 9, the ratio L/D should be higher than about 50%.

FIG. 3 is a graph showing the relationship between the degree of a perfect circle of the sleeves and the focusing characteristic of a color picture tube. Thus, the abscissa shows the degree of a perfect circle in microns (as represented by B-A) while the ordinate shows the ratio of a diameter of a beam spot core portion which produces a uniform, high brightness to a diameter of a beam spot halo portion where the picture image is blurred, when the beam spot impinges upon the peripheral portion of the picture screen. As can be seen from FIG. 3, when the degree of a perfect circle of the inner periphery of the sleeve decreases below about 40 microns, the size of the halo portion increases rapidly to impair the quality of the color picture tube.

Summarizing the above description, in order to elimate the auxiliary electrodes of the main lens electrodes, the L/D ratio should be higher than about 50% and the degree of a perfect circle of the inner periphery of the sleeves shoud be less than about 40 microns.

Two examples of the prior art method of manufacturing the main lens electrode will now be described. As shown in FIGS. 4 and 5, the main lens electrode comprises an oblong main body 10 made of non-magnetic stainless steel and formed with sleeve electrodes 7*a*, 7*b* and 7*c* having an inner diameter of Dmm and acting as a lens. The periphery of each sleeve electrode extends inwardly from the top 11 of the main body. To form sleeve elctrodes 7*a*, 7*b* and 7*c*, the main body 10 is formed as a sleeve with a press. Then, circular openings 12 having a diameter d smaller than that of the inner diameter D of the sleeve electrodes are formed through the top plate 11 of the main body, as shown in FIG. 6. Then, as shown in FIG. 7, the top plate 11 is mounted on a support 13 with the circular opening 12 aligned with openings 30, and punches 14 are inserted into the openings 12 to inwardly bend the portions of the top plate 11 about the openings 12, thus forming the sleeve electrodes 7*a*, 7*b* and 7*c* having a predetermined inner diameter D.

According to this prior art method, however, the upper limit of the ratio L/D is at most 24% which is less than the ratio at which the auxiliary electrodes 9 can be eliminated.

According to another prior method of improving the ratio L/D shown in FIGS. 8, 9 and 10, recesses 15 having an inner diameter slightly smaller than the inner diameter D of the sleeve electrodes are formed in the top plate 11 of the main body. Then, as shown in FIG. 9, circular openings 16 are formed through the bottom walls of the recesses 15. Finally, as shown in FIG. 10, the peripheries of the openings 16 are bent downwardly to form sleeve electrodes 17 having a predetermined inner diameter D.

Although this method can improve the ratio L/D over the method shown in FIGS. 6 and 7, the ratio is at most about 40% which is lower than the condition necessary to eliminate the auxiliary electrodes. According to the latter method, when the sleeve is formed as shown in FIG. 10, circumferential strain will be created at the lower opening 18 of the sleeve so that the degree of a perfect circle near the upper end of the sleeve amounts to 15 to 25 microns, whereas that of the lower opening 18 greatly increases to 40 to 70 microns. For this reason, assuming a practical ratio L/D=40%, it is necessary to heat the electrode after press forming and then to correct the degree of the perfect circle.

SUMMARY OF THE INVENTION

Accordingly, it is an object of this invention to provide a novel in-line type electron gun structure that can eliminate the auxiliary electrodes, and can be readily fabricated with lesser number of component elements.

According to this invention there is provided an in-line type electron gun structure of the type comprising a plurality of electron beam emitters arranged in line, and a plurality of grid electrode assemblies each including a plurality of sleeve-shaped electrodes respectively aligned with the electron beam emitters, wherein each sleeve-shaped electrode has a length equal to at least 50% of an inner diameter thereof and the inner diameter of the sleeve-shaped electrode is gradually increased toward a free end thereof from a point along a length of the sleeve-shaped electrode.

DESCRIPTION OF THE PREFERRED EMBODIMENT

Figure 1:
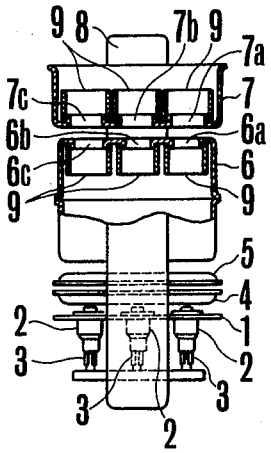
FIG. 1 (PRIOR ART)
FIG. 1 is a side view, partly in section, showing one example of a prior art in-line type electron gun structure.
Figure 2:
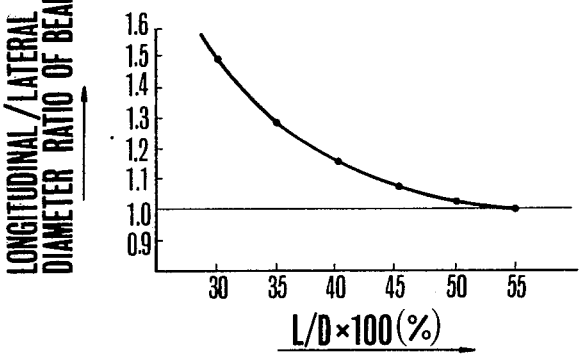
FIG. 2 is a graph showing the relationship between the focusing characteristic at the central portion of the picture image of a color picture tube and sleeves having different lengths.
Figure 3:
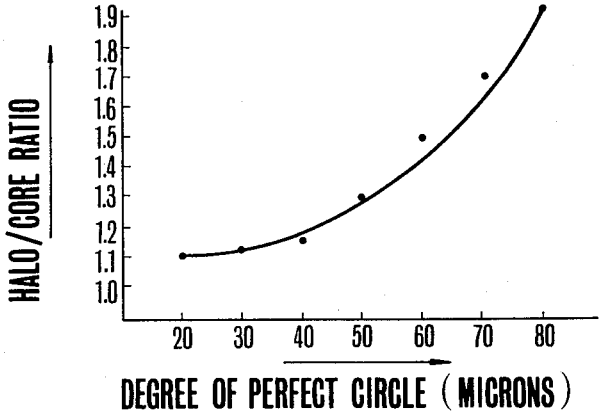
FIG. 3 is a graph showing the relationship between the degree of a perfect circle of the inner periphery of the sleeve electrode and the focusing characteristic at the periphery of the picture image of a color picture tube.
Figure 4:
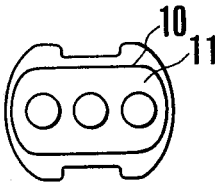
FIG.4 (PRIOR ART)
FIG. 4 is a plan view showing one example of a main lens electrode of a prior art in-line type electron gun structure.
Figure 6:
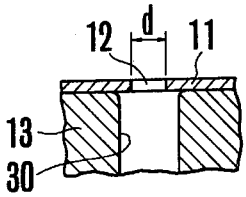
FIG.6 (PRIOR ART)
FIGS. 6 and 7 are sectional views showing one example of the prior art method of manufacturing a sleeve electrode.
Figure 5:
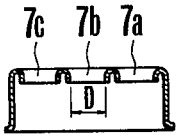
FIG.5 (PRIOR ART)
FIG. 5 is a longitudinal sectional view of the main lens electrode shown in FIG. 4.
Figure 7:
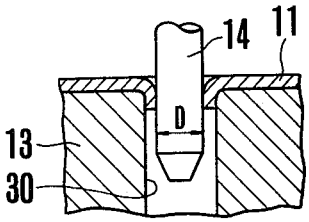
FIG.7 (PRIOR ART)
Figure 8:
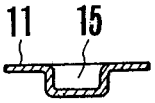
FIG.8 (PRIOR ART)
FIGS. 8, 9 and 10 are sectional views showing successive steps of forming a prior art sleeve electrode.
Figure 9:
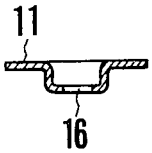
FIG.9 (PRIOR ART)
Figure 10:
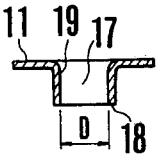
FIG.10 (PRIOR ART)
Figure 11:
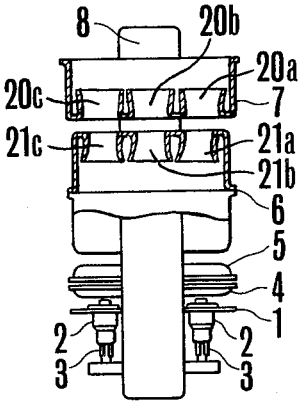
FIG. 11 is a side view, partly in section, showing one example of an in-line type electron gun structure embodying the invention.

In FIG. 11, component elements corresponding to those shown in FIG. 1 are designated by the same reference characters. The fourth grid assembly shown in FIG. 11 is not provided with the auxiliary electrodes and comprises sleeve electrodes 20*a*, 20*b* and 20*c*, each having a ratio L/D higher than 50%, and are formed as an integral unit by press work. Although the characteristic can be improved as the ratio L/D increases, a ratio of 65 to 70% is the upper limit from standpoint of actual manufacturing.

Figure 12:
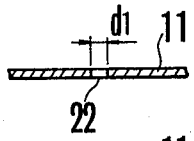
FIGS. 12*a* through 12*f* are sectional views showing successive steps of manufacturing a sleeve electrode of the in-line type electron gun structure embodying the invention.
Figure 12:
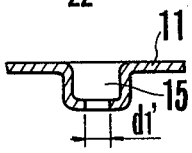
Figure 12:
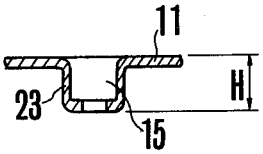
Figure 12:
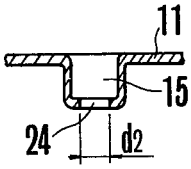
Figure 12:
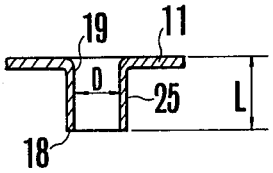
Figure 12:
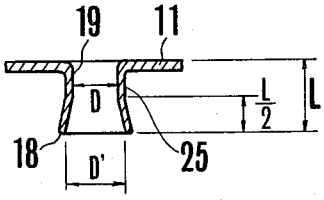

As shown in FIG. 12*f*, the diameter of each one of the sleeve electrodes 20*a*, 20*b* and 20*c* is increased towards its free end from a point 25, preferably at about ½ of the axial length. Also the third grid assembly comprises integral sleeve electrodes 21*a*, 21*b* and 21*c* of the same construction.

A method of manufacturing the third and fourth grid assemblies 6 and 7 will be described hereunder with reference to FIGS. 12*a* through 12*f*. As shown in FIG. 12*a*, a circular opening 22 having a diameter of $d_1$ is formed through the top plate 11. Then as shown in FIG. 12*b*, the plate 11 is squeezed to form a projection 15 having an inner diameter slightly smaller than the inner diameter D of the sleeve electrode. Due to squeezing, the opening is enlarged to have a diameter of $d_1'$ to assist in increasing the height of the projection. Then the projection is further squeezed to increase the height of the projection 15 to a predetermined value H as shown in FIG. 12*c*. Then, as shown in FIG. 12*d*, an opening 24 having a diameter of $d_2$ is formed at the bottom of the projection 15. Then as shown in FIG. 12*e* the bottom of the projection 15 is cut away and the inner diameter D and the length L of the projection or sleeve are determined so as to realize a ratio L/D of larger than 50%. Finally, a cone shaped punch, not shown, is inserted from the bottom opening of the sleeve to gradually increase the diameter D to D' from a point at about one half of the length of the sleeve to correct the degree of the perfect circle. Thus, the accuracy of the degree of the perfect circle can be improved to 15 to 25 microns from the top 19 to the bottom of the sleeve. The enlarged diameter D' of the lower end is larger than the top diameter D by about 1%, thus ensuring the perfect circle. Also the third grid assembly 5 can be prepared in the same manner.

Although in the foregoing description the inner diameter of the sleeve was increased starting from a point at about one half of the length of the sleeve, such point can of course be changed. It is to be understood that all grid assemblies can be prepared in the same manner, and that the cathode is not limited to indirect heating type.

As described above, according to this invention, since the main lens electrode does not require any auxiliary electrode, it is possible not only to cause the sleeve electrode to approach to a perfect circle but also to double the production speed with a reduction of the manufacturing cost to about ⅓ of the prior art. Moreover, as it is possible to increase the inner diameter of the sleeve electrode acting as an electron lens, the performance of the in-line type electron gun structure can be improved.

What is claimed is:

1. In an electron gun structure for a color picture tube assembly having integrally formed lenses comprising a plurality of tubular electrode assemblies, each electrode assembly having a cup formed, in its bottom, with three electron beam passage holes and sleeve-shaped electrodes drawn from the bottom of the cup at peripheral edges of the electron beam passage holes, the bottom of one electrode assembly opposing that of a similar electrode assembly, said sleeve shaped electrodes for the opposed assemblies extending in opposite axial directions and aligned for passage of their respective beams for establishment of an electron lens and each sleeve-shaped electrode terminating in a substantially field-free region and having a length equal to at least 50% of an inner diameter thereof and said inner diameter of said sleeve-shaped electrodes tapered to gradually increase in diameter to a precision circle toward a free end thereof from an intermediate point along the length of the sleeve-shaped electrode.

2. The in-line electron gun structure according to claim 1 wherein said point is at about one half of the length of said sleeve-shaped electrode.

3. The in-line electron gun assembly according to claim 1 wherein the inner diameter is increased by about 1% from said point to the free end of the sleeve-shaped electrode.

* * * * *